US006708844B2

(12) United States Patent
Lim et al.

(10) Patent No.: US 6,708,844 B2
(45) Date of Patent: Mar. 23, 2004

(54) GAS STORAGE AND DELIVERY SYSTEM FOR PRESSURIZED CONTAINERS

(76) Inventors: Walter K. Lim, 14720 Horticultural Dr., Hacienda Heights, CA (US) 91745; Arthur A. Krause, 20539 Archwood St., Winnetka, CA (US) 91306

( * ) Notice: Subject to any disclaimer, the term of this patent is extended or adjusted under 35 U.S.C. 154(b) by 0 days.

(21) Appl. No.: 09/932,576

(22) Filed: Aug. 16, 2001

(65) Prior Publication Data

US 2003/0106908 A1 Jun. 12, 2003

Related U.S. Application Data

(60) Provisional application No. 60/225,817, filed on Aug. 16, 2000.

(51) Int. Cl.[7] ..... B67D 5/00
(52) U.S. Cl. ..... 222/3; 222/394; 222/402.1
(58) Field of Search ..... 222/386.5, 394, 222/402.1, 3

(56) References Cited

U.S. PATENT DOCUMENTS

| | | | | | |
|---|---|---|---|---|---|
| 3,974,945 | A | * | 8/1976 | Burger | 222/192 |
| 5,009,340 | A | * | 4/1991 | Morane | 222/94 |
| 5,234,140 | A | * | 8/1993 | Demarest et al. | 222/394 |
| 5,398,850 | A | * | 3/1995 | Sancoff et al. | 222/386.5 |
| 5,526,957 | A | | 6/1996 | Brown et al. | 222/94 |
| 5,562,235 | A | | 10/1996 | Cruysberghs | 222/396 |
| 5,700,245 | A | | 12/1997 | Sancoff et al. | 604/145 |
| 5,912,424 | A | | 6/1999 | Judkins et al. | 95/143 |
| 5,992,700 | A | * | 11/1999 | McGlothlin et al. | 222/187 |
| 6,030,698 | A | | 2/2000 | Burchell et al. | 428/315.5 |

* cited by examiner

*Primary Examiner*—Joseph A. Kaufman
(74) *Attorney, Agent, or Firm*—Dennis H. Lambert

(57) ABSTRACT

A gas storage and delivery system for replacing gas lost from a pressurized container or a carbonated beverage, or for introducing a gas such as oxygen into a beverage such as bottled water or a sports drink.

17 Claims, 2 Drawing Sheets

GAS STORAGE AND DELIVERY SYSTEM FOR PRESSURIZED CONTAINERS

This application claims the benefit of U.S. provisional application Ser. No. 60/225,817, filed Aug. 16, 2000, entitled GAS STORAGE AND DELIVERY SYSTEM FOR PRESSURIZED CONTAINERS.

BACKGROUND OF THE INVENTION

1. Field of the Invention

This invention relates generally to pressurized containers, and more particularly, to a gas storage and delivery system for restoring and maintaining pressure as it is depleted from pressurized containers such as aerosol dispensers, bottles of carbonated beverage, and the like.

2. Prior Art

Pressurized containers are commonly used to dispense many products, including paint, lubricants, cleaning products, hair spray, and food items. These containers are typically aerosol dispensers in which the product is stored under pressure with a suitable propellant. Dispensing of the product occurs when a discharge nozzle is depressed, permitting the pressurized product to be forced out through the nozzle, usually as a spray, stream or foam. As product is depleted from the container, the pressure exerted by the propellant decreases, especially evident with compressed gases, and may become diminished to the extent that all of the product cannot be dispensed from the container, or desired characteristics are not achieved.

Many products, e.g., hair spray, require a carrier in addition to the propellant component, e.g., alcohol, that dries quickly upon discharge from the container. Volatile organic compounds (VOCs) such as propane, isobutane, dimethyl ether, and the like, are suitable as propellants for many products, but their use is limited due to environmental concerns. For instance, under some current regulations no more than 55% of the contents of the container can comprise a VOC. In an aerosol dispenser, as much as 25% of the VOC could be required for use as a propellant, leaving about 30% VOC in the product. This 25% reduction typically is made up with water, which does not dry as quickly as the VOC, resulting in a "wet" product when used.

Carbon dioxide ($CO_2$) is environmentally friendly, and is therefore useful as an aerosol propellant, but its use has been limited due to the drop off in pressure from start to finish as the product is used. For example, in a typical situation the starting pressure might be 100 psig and the finishing pressure only 30 psig. At this low finishing pressure all of the product may not be discharged, and/or proper aerosolization may not be obtained.

Carbonated beverages are also bottled under pressure, usually by a pressurized inert gas, such as $CO_2$, placed in the bottle along with the beverage. Over time, the pressure of the gas may decrease, resulting in a "flat" drink. This is particularly true when plastic containers are used to bottle carbonated beverages. The shelf life of such products may be undesirably short.

Further, cans of pressurized gas are provided for cleaning dust and the like from sensitive equipment, such as computers, computer keyboards, etc., by blowing a pressurized stream of propellant onto the equipment. Currently available products for this purpose use a VOC (e.g., Dymel® by DuPont) as the propellant. These materials are relatively expensive for the intended use.

Accordingly, there is a need for a system to replenish and maintain a desired pressure in pressurized containers, such as aerosol dispensers and carbonated beverages, and particularly to such a system that is inexpensive and environmentally friendly.

SUMMARY OF THE INVENTION

The present invention provides a system and method to replenish and maintain a desired pressure in pressurized containers, such as aerosol dispensers and carbonated beverages.

In accordance with the invention, a gas storage system is employed in pressurized containers to store and release gas to replenish pressurized gas depleted from the container. More particularly, the invention uses a material that is capable of adsorption and storage of a large quantity of gas, and then releasing it under predetermined conditions. Additionally, the material of the invention is a non-toxic material.

The storage body used in the invention is known as a pressure swing adsorption (PSA) system, wherein adsorption of gas into the body occurs at a high pressure, and desorption of gas from the body occurs at a low pressure. Such adsorption/desorption devices are capable of storing under pressure a volume of gas that is 18 to 20 times the volume of the body.

For example, the invention may use a storage body made from granular activated carbon, or a carbon fiber composite molecular sieve (CFCMS) material, to adsorb and store a quantity of a desired gas, such as nitrous oxide or carbon dioxide, for example. The storage body may be pre-charged with the desired gas and then placed in a pressurized container, or in communication with the interior of the container, or it may be placed in a container and a desired gas introduced under pressure into the container to charge the storage body, for subsequent release of the gas as the propellant or carbonization gas becomes depleted, thereby restoring the pressure in the container to a desired level.

A mass of granular activated carbon may be formed into a cohesive shape such as a ball or cube or the like which is simply placed in the container, or the mass of activated carbon may be encased in a film or cover. The cover may be something that functions only to contain the carbon and prevent its admixture and discharge with the product, or it may be a gas permeable membrane that is capable of passing the desired gas but prevents contact between the carbon and the liquid or other product in the container. One suitable source of granular activated carbon, for example, is a 10×50 mesh material available from Westvaco Corporation under number 1072-R-99. One suitable film may comprise a Tetratex® 1316 membrane film, for example, available from Tetratec PTFE Technologies.

For some applications, nitrous oxide may be used in lieu of or in combination with carbon dioxide. Nitrous oxide is more compatible with products having an oil component, for example.

An alternative storage body can comprise a carbon fiber composite molecular sieve (CFCMS) material, as disclosed in U.S. Pat. Nos. 5,912,424 and 6,030,698, which are incorporated in full herein.

During filling of an aerosol container, the storage body may be placed in the container and a suitable propellant gas introduced into the container to a pressure of 150 psig, for example, whereupon the body will adsorb 75 psig, for example. Product is then introduced into the container, increasing the pressure back up to 80 to 100 psig, for example. As product is expelled, gas is released from the body to restore the pressure in the container to a desired predetermined level.

The body may have any desired shape, such as spherical, tubular, cubic, etc., and may have any desired suitable size to store and release an appropriate amount of gas during use of the system. Further, the carbon material may be enclosed within a suitable membrane for one-way flow of the gas out of the material and through the membrane into the container, while precluding direct contact between the product and the carbon. Such membranes are employed in reverse osmosis water purification systems, for example.

The gas storage and release system of the invention may also be used to discharge oxygen or another gas into a beverage, such as bottled water or a sports drink, if desired.

In essence, the invention comprises the use of a gas adsorption material in a pressurized container as a reservoir for a gas such as carbon dioxide, nitrous oxide, and the like, and which releases the gas into the container as the pressure in the container decreases as product is dispensed, thus maintaining a desirable pressure in the container and obtaining a more uniform product discharge from beginning to end.

The use of activated carbon to adsorb additional gas in an aerosol container can increase the available gas to a level which results in the pressure remaining more uniform until the product is depleted. This, in turn, maintains a more consistent, uniform and acceptable spray pattern from beginning to end because the pressure at the end is very close to the starting pressure.

The carbon dioxide can be used alone or in combination with other gases, such as nitrous oxide, or the nitrous oxide can be used alone or in combination with other gases, and/or any one or all of these can be used in combination with liquified compressed gases such as propane, isobutane, dimethyl ether or Dymel® (trademark of DuPont), to produce desired spray patterns which would permit reduction in the quantity of volatile organic compounds used in the pressurized product.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
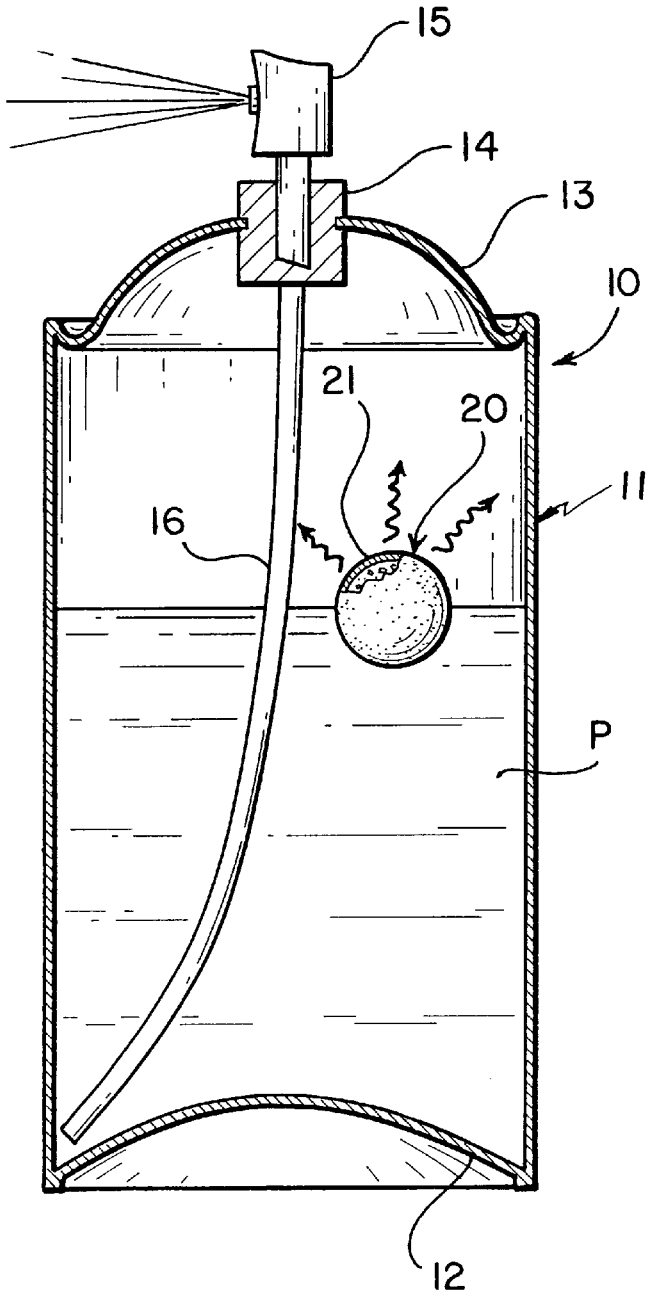
FIG. 1 is a somewhat schematic longitudinal sectional view of an aerosol dispenser employing a gas storage and release system according to the invention.

An aerosol dispenser is indicated generally at 10 in FIG. 1. The dispenser includes a container 11 made of metal or other suitable material, having a bottom 12 and a top 13. A discharge nozzle assembly 14 is mounted on the top and includes a nozzle 15 that may be manually depressed to open and permit product P to be dispensed from the container through the nozzle. A dip tube 16 extends from the bottom of the container to the discharge nozzle assembly. As seen in this figure, the level of product in the container does not occupy the entire volume of the container, and the space above the product level is filled with a pressurized propellant gas to exert pressure on the product and force it through the dip tube and nozzle when the nozzle is depressed. The foregoing structure and operation are conventional.

In accordance with the invention, a storage body 20 of a gas-adsorbing material such as granular activated carbon, or carbon fiber composite molecular sieve (CFCMS) material, is placed in the container with the product to adsorb and store a quantity of a desired gas, such as carbon dioxide, nitrous oxide, for example. The body is capable of storing, under pressure, a volume of gas that is many times greater than the volume of the body. For instance, the CFCMS material can hold 18 to 20 times the volume of the body. As disclosed herein, the storage body is known as a pressure swing adsorption (PSA) system, wherein adsorption of gas into the body occurs at a high pressure, and desorption of gas from the body occurs at a low pressure. Thus, as the pressure of the propellant gas in the container falls below a predetermined threshold value, gas is released from the body, restoring the pressure in the container.

The body 20 may be formed as a cohesive block of carbon material, e.g., granular activated carbon or carbon fiber composite molecular sieve (CFCMS) material, which is placed in the container in contact with the product. Gas, such as carbon dioxide, is stored in the carbon material and released to restore pressure in the container as product is dispensed.

Figure 5:
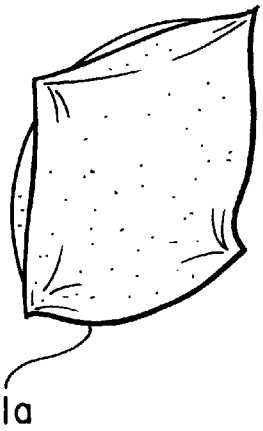
FIG. 5 is a perspective view of a body of gas-adsorbing material enclosed in a porous film or cover.
Figure 6:
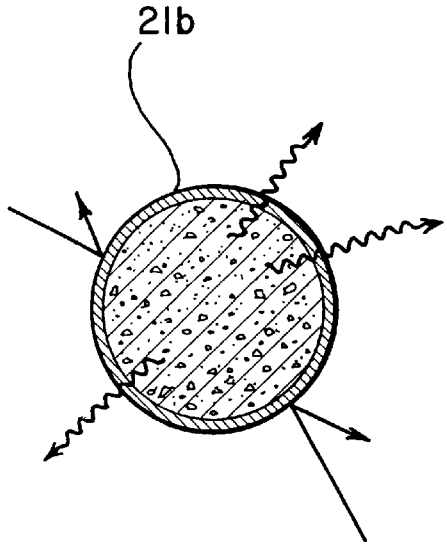
FIG. 6 is a transverse sectional view of a body of gas-adsorbing material enclosed in a gas permeable membrane.

A film or cover 21 may be placed around the body of carbon material to prevent dispersion of the carbon into the product, and/or to prevent direct contact between the carbon and product. That is, the film may comprise a porous member 21*a* (see FIG. 5) that simply contains the carbon material and permits free flow of gas and product, or it may comprise a membrane or film 21*b* (see FIG. 6) that permits flow of carbon dioxide outwardly through the film into the product, but prevents flow of product into the carbon material. For example, the film 21*b* may comprise a reverse osmosis membrane placed around the body of carbon fiber material to permit flow of gas from the body into the product, but to prevent flow of product through the membrane to the body.

Figure 2:
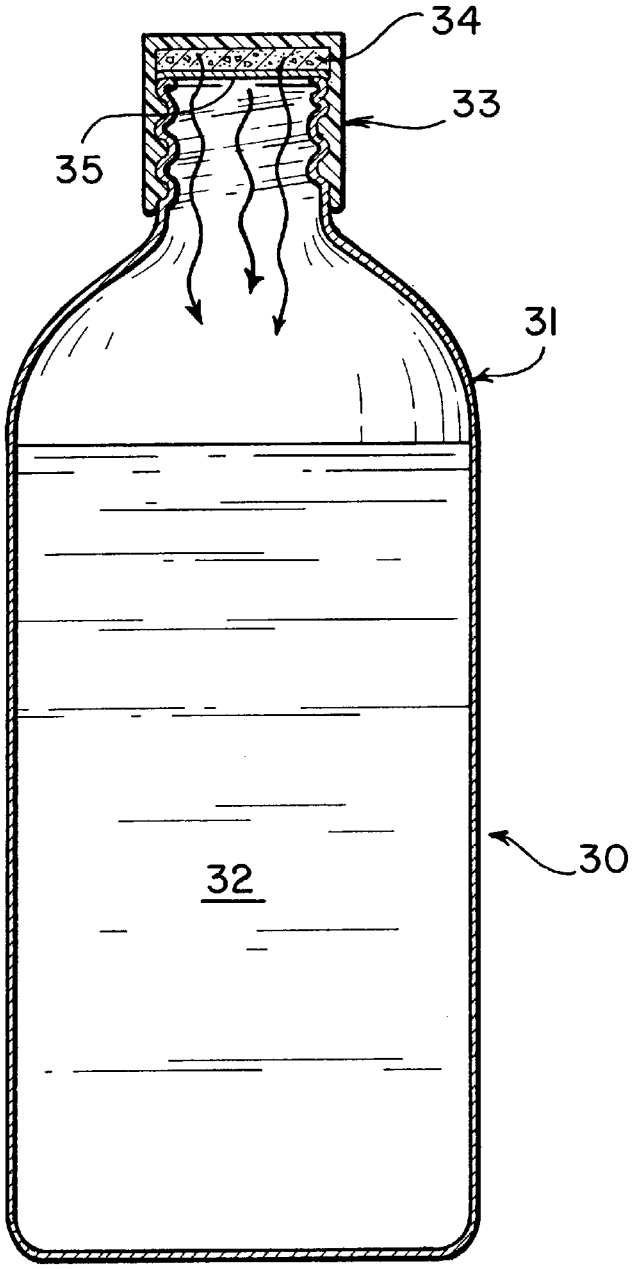
FIG. 2 is a somewhat schematic longitudinal sectional view of a beverage bottle containing a beverage, and having a gas storage and release system according to the invention incorporated into the cap.
Figure 3:
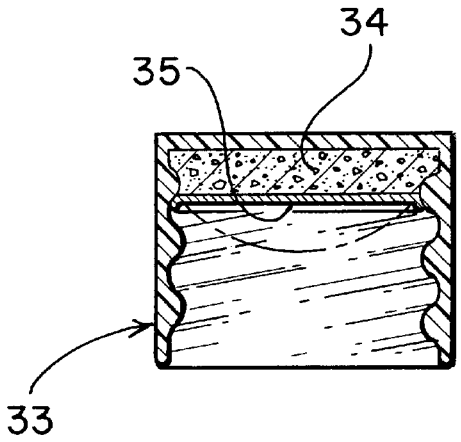
FIG. 3 is an enlarged longitudinal sectional view of a bottle cap incorporating the gas storage and release system of the invention.
Figure 4:
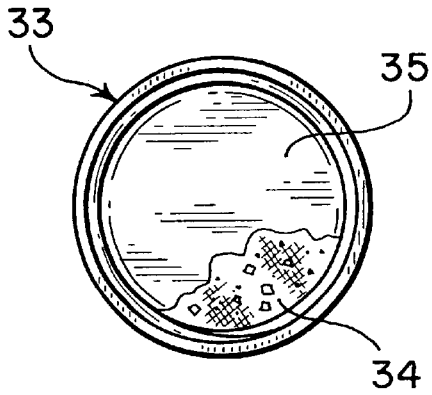
FIG. 4 is an end view of the cap of FIG. 3, looking in the direction of the arrow 4, with portions broken away.

Use of the invention to store and release gas into a beverage is shown generally at 30 in FIGS. 2–4. In this embodiment, a beverage bottle 31 has a quantity of beverage 32 therein, and a closure cap 33 placed on the end of the bottle.

In accordance with the invention, a storage body 34 of activated carbon, or carbon fiber composite molecular sieve (CFCMS) material, is placed in the cap. If desired, the body may be isolated from the interior of the bottle by a suitable film or cover, such as reverse osmosis membrane 35.

If the beverage is a carbonated beverage, the body may store a quantity of $CO_2$, which is released from the body into the container to restore pressure in the container, and $CO_2$ into the beverage, lost due to depletion of the beverage and the $CO_2$, or permeation of the $CO_2$ through the container wall.

The beverage may also comprise water, or a sports drink, and the gas can comprise $O_2$, to give a boost of energy to a person drinking from the bottle.

While particular embodiments of the invention have been illustrated and described in detail herein, it should be understood that various changes and modifications may be made to the invention without departing from the spirit and intent of the invention as defined by the scope of the appended claims.

What is claimed is:

1. A gas storage and delivery system for restoring pressure as it is depleted from a pressurized containers, comprising:

a container holding a product under pressure to be dispensed from the container;

a quantity of gaseous material under pressure in the container, occupying a head space in the container and applying to the product a predetermined pressure of from about 70 to about 100 psig; and a quantity of gas-adsorbing material in the container with the product, storing under pressure a quantity of the gaseous material and releasing it into the container in response to a decrease in pressure in the head space, thereby restoring and maintaining a predetermined pressure in the container as product is depleted from the container.

2. A gas storage and delivery system as claimed in claim 1, wherein:

the gaseous material is carbon dioxide.

3. A gas storage and delivery system as claimed in claim 1, wherein:

the gaseous material is oxygen.

4. A gas storage and delivery system as claimed in claim 1, wherein:

the gas adsorbing material comprises granular activated carbon.

5. A gas storage and delivery system as claimed in claim 4, wherein:

the granular activated carbon is formed into a cohesive body of material that retains its shape in the container, and said body is in contact with the product.

6. A gas storage and delivery system as claimed in claim 4, wherein:

a film or cover is placed around the activated carbon to prevent dispersal of the carbon into the product but to enable flow of the stored gaseous material from the carbon into the product.

7. A gas storage and delivery system as claimed in claim 6, wherein:

the film or cover prevents contact between the carbon and the product.

8. A gas storage and delivery system as claimed in claim 1, wherein:

the gas adsorbing material comprises a carbon fiber composite molecular sieve material.

9. A gas storage and delivery system as claimed in claim 1, wherein:

the gaseous material is an inert gas.

10. A gas storage and delivery system as claimed in claim 1, wherein:

the gas-adsorbing material is a carbon material, and the gaseous material adsorbed on the carbon material comprises carbon dioxide.

11. A gas storage and delivery system as claimed in claim 1, wherein:

the gas-adsorbing material is a carbon material, and the gaseous material adsorbed on the carbon material comprises nitrous oxide.

12. A gas storage and delivery system as claimed in claim 1, wherein:

a normally closed discharge nozzle is on the container for releasing the product when the discharge nozzle is moved to an open position.

13. A gas storage and delivery system for restoring and maintaining pressure and carbonation in carbonated beverages, comprising:

a container holding a carbonated beverage;

a quantity of gaseous material under pressure in the container, said gaseous material serving to carbonate the beverage; and a quantity of gas-adsorbing material in the container storing under pressure a quantity of the gaseous material and releasing it into the container as pressure is depleted from the container, to thereby restore and maintain a predetermined level of carbonation in the carbonated beverage.

14. A gas storage and delivery system as claimed in claim 13, wherein:

a cap is on the container to close and seal the container, and the gas-adsorbing material is carried in the cap in communication with the interior of the container.

15. A gas storage and delivery system for adding a gaseous supplement to a beverage, comprising:

a container holding a beverage;

gas-adsorbing means in the container in communication with the beverage; and a gaseous supplement stored in the gas-adsorbing means for release of the gaseous supplement into the beverage.

16. A gas storage and delivery system as claimed in claim 15, wherein:

the gaseous supplement is oxygen.

17. A gas storage and delivery system for storing and discharging under pressure a quantity of gaseous material, comprising:

a container holding a quantity of the gaseous material under pressure;

a normally closed discharge nozzle on the container for releasing the gaseous material when the discharge nozzle is moved to an open position; and a quantity of gas-adsorbing material in the container storing a quantity of the gaseous material and releasing it into the container to restore and maintain pressure in the container and to replace gaseous material discharged through the discharge nozzle, thereby prolonging the useful life of the gas storage and delivery system.

* * * * *